US005711242A

United States Patent [19]

Blanc et al.

[11] Patent Number: 5,711,242

[45] Date of Patent: Jan. 27, 1998

[54] DEVICE FOR MOORING A CRAFT TO A DOCKING POINT

[75] Inventors: Pierre Blanc, Aix-En-Provvence; Alain Lecoq, Sartrouville, both of France

[73] Assignee: GTM, Nanterre, France

[21] Appl. No.: 596,118

[22] PCT Filed: Jul. 29, 1994

[86] PCT No.: PCT/FR94/00963

§ 371 Date: Feb. 27, 1996

§ 102(e) Date: Feb. 27, 1996

[87] PCT Pub. No.: WO95/04193

PCT Pub. Date: Feb. 9, 1995

[30] Foreign Application Priority Data

Jul. 30, 1993 [FR] France ..... 93 09433

[51] Int. Cl.[6] ..... B63B 21/00

[52] U.S. Cl. ..... 114/230

[58] Field of Search ..... 114/230, 293, 114/294, 295, 297, 310, 311, 221 R

[56] References Cited

U.S. PATENT DOCUMENTS

| | | | |
|---|---|---|---|
| Re. 27,050 | 2/1971 | Jorgenson | 114/230 |
| 4,459,930 | 7/1984 | Flory | 114/230 |
| 4,834,437 | 5/1989 | Howard | 114/230 |
| 5,145,131 | 9/1992 | Hall | 114/230 |

FOREIGN PATENT DOCUMENTS

| | | | |
|---|---|---|---|
| 2209352 | 6/1974 | France | 114/230 |
| 1395886 | 5/1975 | United Kingdom | 114/230 |

*Primary Examiner*—Stephen Avila
*Attorney, Agent, or Firm*—Young & Thompson

[57] ABSTRACT

A device for mooring a craft to a docking point (2), including a guide rail (3) vertically attached to the docking point (2), and a prehensile assembly (4) secured to the craft and comprising jaws (6) for gripping the guide rail (3) when in their closed position. An actuator assembly (7) secured to the craft is designed to move the jaws (6) between the closed position and an open position in which the jaws (6) are spaced away from the guide rails (3). The device is useful for mooring a craft to a wharf or to another craft.

12 Claims, 3 Drawing Sheets

DEVICE FOR MOORING A CRAFT TO A DOCKING POINT

FIELD OF THE INVENTION

The present invention concerns a device for mooring a craft to a docking point such as a quay or another craft.

BACKGROUND OF THE INVENTION

Known mooring devices generally consist of mooring ropes or cables which are knotted about one or more posts distributed on the length of the quay.

However, this mooring technique is tedious since it requires that one or more people manually fix these ropes, which can be very heavy, to the mooring posts.

In addition, in order to account for variations in water level with time, generated by tides for example, a sufficient length of rope must be left free between the craft and the mooring post.

Such a mooring device also has the disadvantage of occupying circulation areas on quays, particularly due to the presence of the posts and the ropes, which is all the more inconvenient since quays are frequently used for loading and unloading crafts such as barges or canal boats.

Document U.S. Pat. No. 4,834,437 describes a device for assisting in docking to a fixed post on a quay.

But this device does not make it possible, on the one hand, to obtain the mooring, i.e. the rigid joining and retention, up to predetermined stress values, of a craft.

On the other hand, it does not make it possible to obtain a mooring to a fixed point of which only two opposite surfaces are free, and which can therefore not be encircled on its full periphery.

The present invention makes it possible to eliminate the above-mentioned disadvantages for the docking and mooring of crafts to quays or to other crafts which need to be pushed or towed.

SUMMARY OF THE INVENTION

The mooring device which the invention is concerned with particularly makes it possible to quickly and firmly moor the crafts to a docking point.

According to the invention, this device comprises at least one guide rail fixed vertically to the docking point and clamp forming means rigidly joined to the craft and including jaws suited for clamping the guide rail in a closed position and for moving along the guide rail, driving means rigidly joined to the craft being suited for moving the jaws between said closed position and an open position in which the jaws are separated from the guide rail.

The mooring device according to the invention thus makes it possible to very quickly moor the craft to its docking point, by mere clamping.

It is particularly suited for ships of medium tonnage having to frequently perform mooring manoeuvres.

In addition, only the clamp forming means extend between the craft and the guide rail, as the latter can be fixed to a vertical wall of the quay or to another craft, which makes it possible to leave the quay or the bridge of the other craft entirely free and not hinder the circulation of people or merchandise in these places.

In addition, since the driving means are rigidly joined to the craft, the mooring of the latter can be performed by a person aboard, without the latter being forced to leave the craft to fix the mooring device.

Since the guide rail has a cross section of constant shape in the longitudinal direction, the clamp forming means can clamp the rail on any area along its length, which thus makes it possible to moor the craft regardless of the water level with respect to the quay.

Similarly, when two crafts are rigidly joined using the mooring device according to the invention, the clamp forming means can move along the guide rail when there are variations of heel and trim between the two crafts.

BRIEF DESCRIPTION OF THE DRAWINGS

Other features and advantages of the invention will be understood upon reading the description which follows, made with reference to the attached drawings which are provided as an example on a non limiting basis and in which.

DETAILED DESCRIPTION OF THE INVENTION

Figure 1:
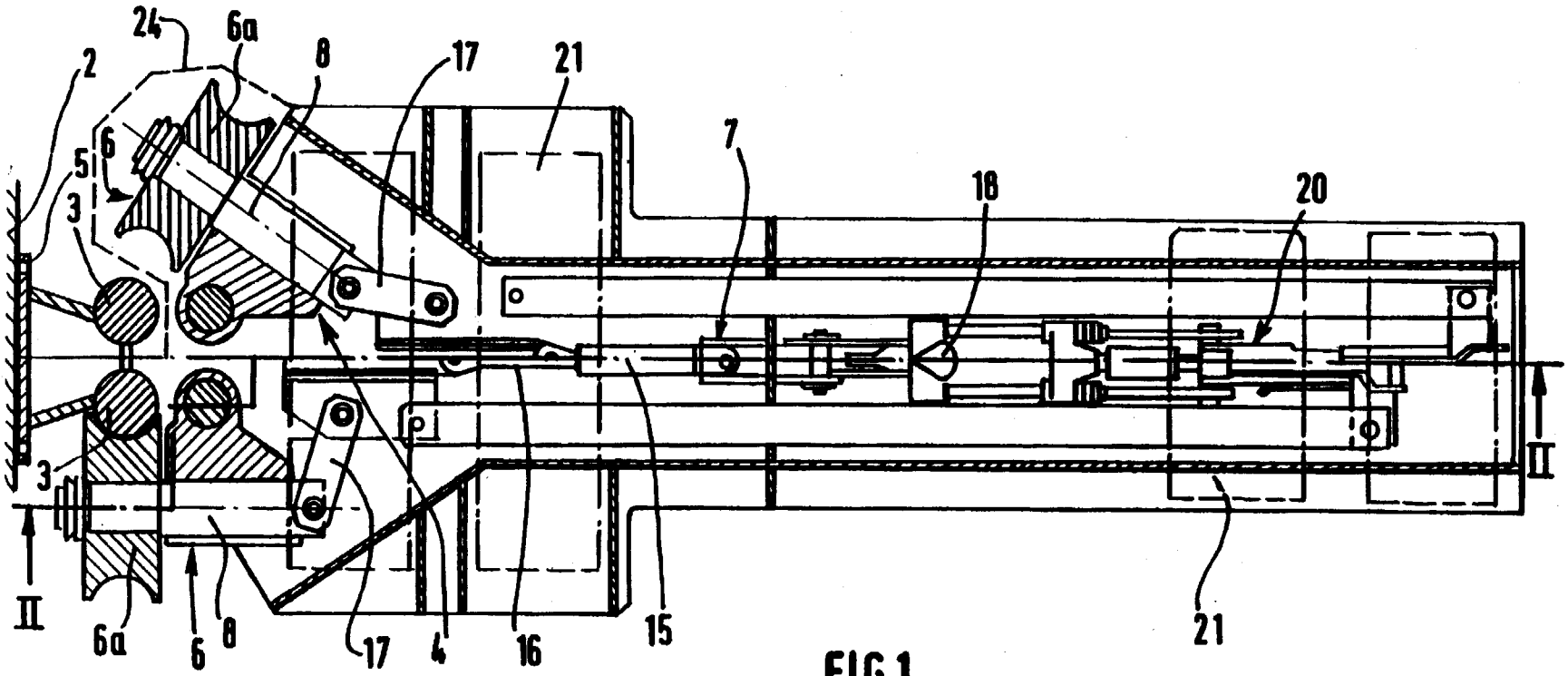
FIG. 1 is a top sectional view of the mooring device according to the invention.
Figure 2:
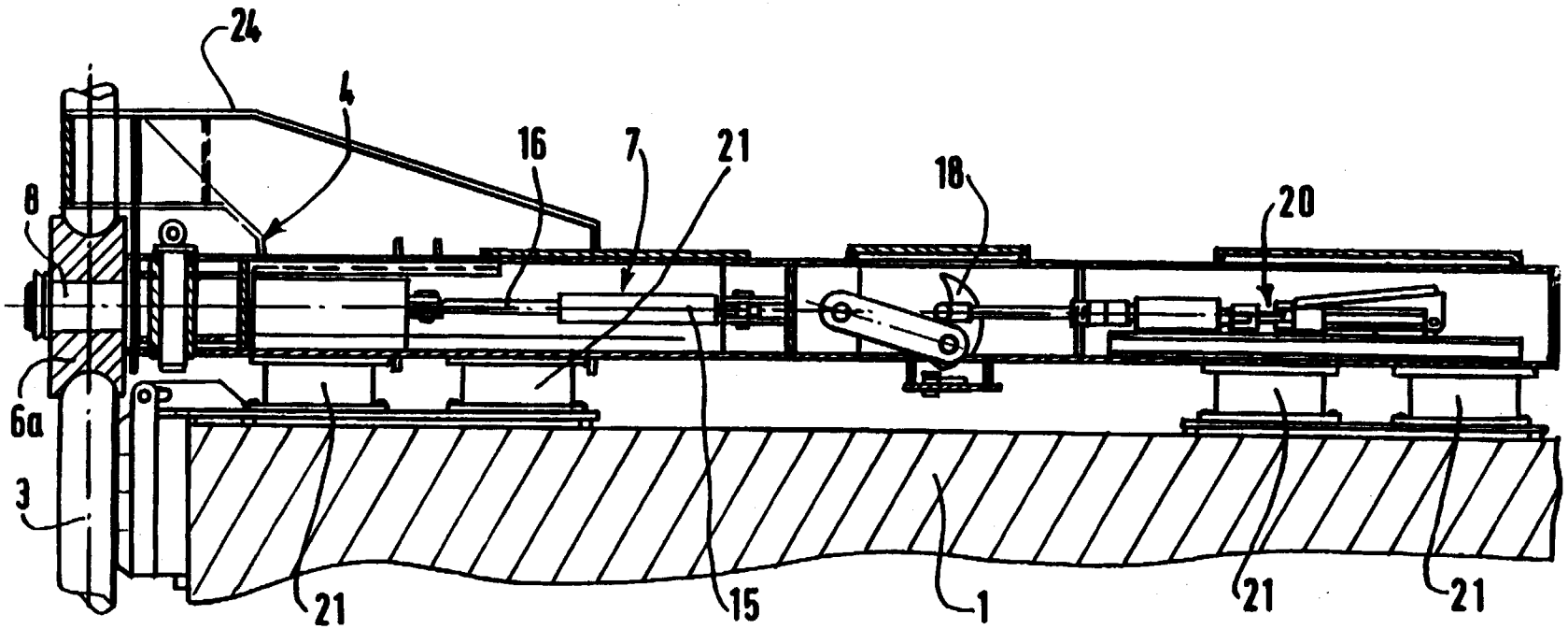
FIG. 2 is a sectional view taken along II—II in FIG. 1.

Referring to FIGS. 1 and 2, the device according to the invention for mooring a craft 1, such as a barge, to a docking point 2 will now be described.

The latter can, for example, be a quay, so as to perform the loading or the unloading of the barge, or another craft, so as to push or pull the latter.

The docking point 2 can also be a dolphin.

In this example of an embodiment, the mooring device includes two parallel guide rails 3 fixed vertically to the docking point 2.

These rails 3 are supported by a frame 5 capable of withstanding the tractive stress produced by the craft 1 on the rails 3. The latter are welded onto the frame 5 which makes it possible to concentrate the stress on the docking point 2.

This frame 5 is fixed, by screwing for example, to a wall substantially vertical to the docking point 2.

The guide rails 3 have a constant cross-sectional profile as shown in FIG. 1.

In this example of an embodiment suited for taking up mooring stresses of approximately 100 tonnes, the guide rails 3 have a circular cross section, with a diameter equal to approximately 300 mm.

The guide rails 3 have to be sufficiently long to make it possible to moor the craft 1 to the quay 2 regardless of the water level, particularly during variations produced by tides.

Similarly, when these rails 3 are fixed to another craft, they must make it possible to moor the craft regardless of the difference in level with respect to one another.

In addition, clamp forming means 4, rigidly joined to the craft 1, include jaws 6 suited for clamping the guide rails 3 in a closed position.

This closed position is illustrated by one of the two jaws 6 located beneath the axis of FIG. 1. The jaws 6 thus clamp the two guide rails 3 on faces opposite to one another.

These jaws 6 respectively comprise a roller 6*a* suited for rolling on the rails 3.

The rollers 6*a* are mounted so as to respectively rotate on a support shaft 8 by means of a plain bearing 9.

Figure 3:
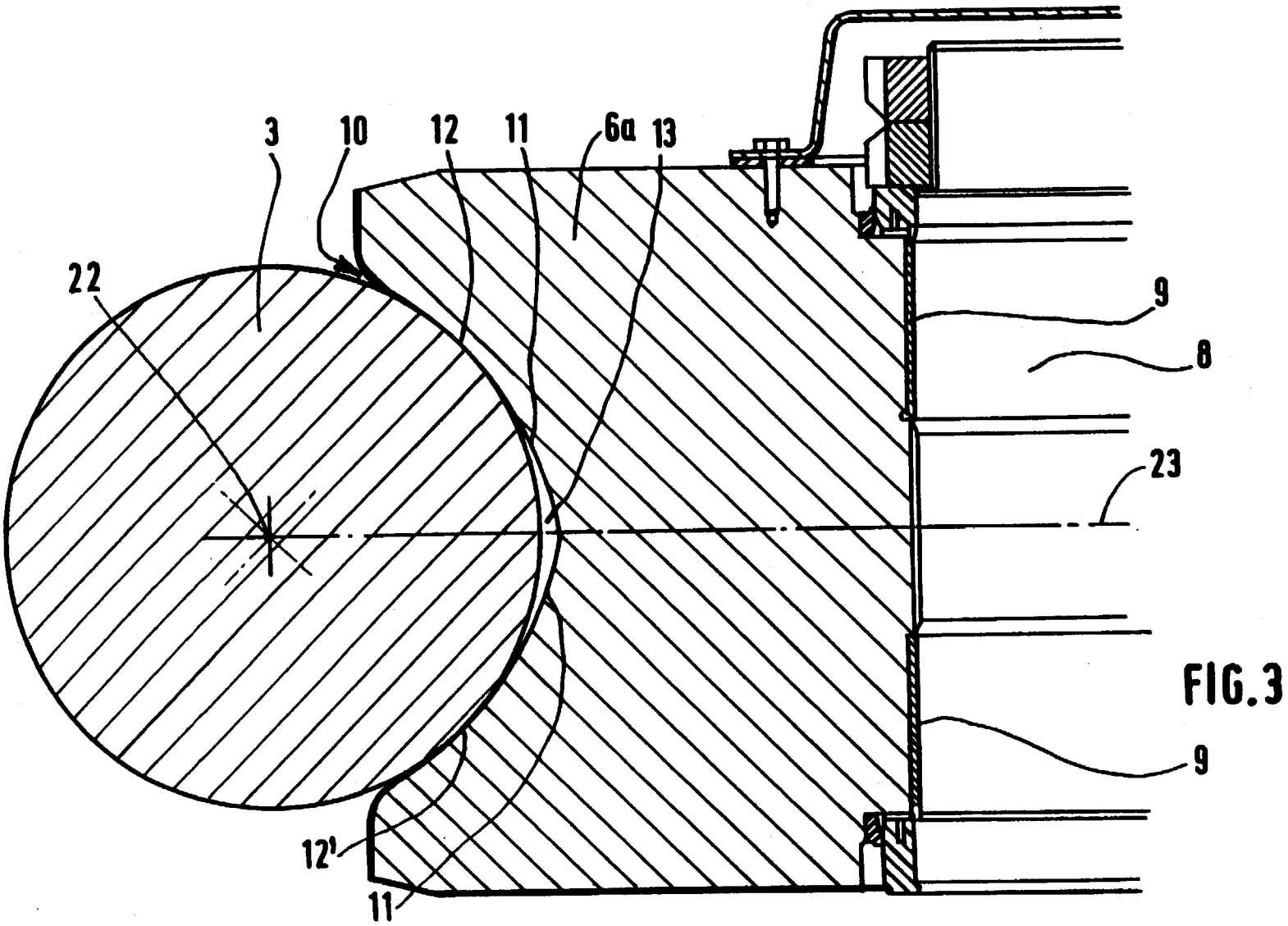
FIG. 3 is an enlarged sectional view of a roller suited for rolling on a guide rail.

This plain bearing 9, shown in FIG. 3, includes a polytetrafluorethylene covering so as to obtain a virtually frictionless surface to enable the rotation of the roller 6a about this bearing 9. This bearing can certainly be replaced with any other equivalent solution, such as a ball or roller bearing, a bronze bearing, etc., or the polytetrafluorethylene can be replaced with another material having a low coefficient of friction, without departing from the scope of the invention.

Each roller 6a includes a groove 10 suited for accommodating part of a guide rail 3.

This groove 10 has a cross-sectional profile consisting of two adjacent identical portions 11 of the arc of a circle with a radius of curvature greater than the radius of curvature of the circular cross section of the guide rail 3.

Each portion 11 of the arc of a circle is tangent to the guide rail 3 at a distinct point 12, 12' when the jaws 6 are in closed position, i.e. in contact with the guide rail 3.

This specific shape of the cross-sectional profile of the groove 10 of the rollers 6a makes it possible to leave a space 13 between the groove 10 and the guide rail 3. This arrangement makes it possible to ensure that the angle formed by the segment joining the center 22 of the section of the rail to the point of contact 12 or 12' and by the mid-plane 23 of the roller 6a is close to 45°. An appropriate play between the rollers 6a and the guide rail 3 allows for the rolling and pitching movements of the craft 1.

As shown in FIG. 2, the mooring device includes driving means 7 rigidly joined to the craft and suited for moving the jaws 6 between the closed position and the open position in which the jaws 6 are separated from the guide rail 3.

In this open position, as illustrated above the axis of FIG. 1, the craft 1 is not moored to the guide rail 3.

These driving means 7 comprise an actuator 15 suited for moving, to-and-fro, a rod 16 connected to each jaw 6 of the clamp forming means respectively by means of a connecting rod 17.

Thus, the to-and-fro motion of the rod makes it possible to move the jaws in a rotating manner by means of the connecting rod 17.

The jaws 6 are simultaneously driven in opposite directions of rotation. They move towards each other to reach the closed position, and they move away from each other to release the craft 1 from its docking point 2.

When the jaws 6 are moved from their closed position to their open position, they are retracted at the limit of travel of the rod 16 of the actuator 15 so as to no longer protrude from the craft 1 and therefore not hinder the docking and displacement of the craft 1.

This actuator 15, preferably hydraulic, thus makes it possible to move the two jaws 6 in a symmetrical manner with respect to the center axis of the mooring device.

This actuator 15 can be controlled automatically using controls placed directly inside the pilot cabin of the craft 1, for example.

The mooring device can thus be manoeuvred by a person aboard the craft 1.

The driving means 7 further include a manual control 18 suited for placing the jaws 6 of the clamp forming means 4 in their open position.

This manual control 18 particularly makes it possible for a person aboard the craft to very quickly release the craft 1 from its docking point 2, particularly in the case of danger or excessively vigorous stresses imposed on the craft 1 at its docking point.

To perform this manual release quickly, it is merely sufficient to provide, for example, a manual distributor on the power supply circuit of the actuator 15 to control the return of the rod 16 towards the interior of the mooring device.

A rupture device 20 suited for withstanding the tractive force existing between the guide rails 3 and the clamp forming means 4 in closed position is also provided. It is suited for automatically controlling, above a maximum tractive force, the driving means 7 to place the clamp forming means 4 in open position.

This rupture device 20, similar to a mechanical fuse, makes it possible, when the tractive forces between the guide rails 3 and the rollers 6a are too significant, to automatically open the mooring device and thus detach the craft 1 from its docking point 2.

In the example described, each mooring device is dimensioned so as to withstand stresses in the order of 70 T in the direction parallel to the longitudinal axis of the device and of 35 T in the horizontal direction perpendicular to this axis. The invention can of course be suited for any other stress values.

Beyond these values, the rupture device 20 is suited for releasing the craft 1 from its docking point 2.

In a preferred embodiment of the invention, the mooring device according to the invention is fixed to the craft 1 by means of dampers 21 which make it possible to limit the docking or pushing stresses on the craft 1, and to absorb the corresponding energies.

All of the mobile members of the device, i.e. the clamp forming means 4, the driving means 7 and the rupture device, are mounted inside a casing 24, the latter being fixed to the craft 1 by means of dampers 21 consisting of pieces made of elastomer material, for example.

A system of chains or stops (not shown) can make it possible to limit, in the longitudinal and transversal directions, the warping of the dampers 21 and to keep the entire system in place in case of breakage of the dampers 21.

The craft 1 can include two mooring devices respectively arranged on each of its longitudinal sides, the clamp forming means 4 protruding from the front of the craft, so as to be moored to the rear or to the front of another craft.

It can also include a mooring device on one of its longitudinal sides and another mooring device arranged perpendicularly to the first on a transversal side of the craft, so that the clamp forming means 4 are arranged according to a diagonal of the craft 1. Such an arrangement makes it possible to moor the craft 1 to a quay forming a right angle at two mooring points.

In addition, each mooring device can be coupled to a mechanical centering device, similar to a structure with a V-shaped profile on a horizontal plane, suited for centering the craft 1 on the guide rails 3.

This centering device enables a precise positioning of the craft 1 with respect to the quay 2 and then makes the mooring easier. In a preferred version of the invention, this V-type centering device is incorporated in the casing 24 of the mooring device, so that the casing 24 makes it possible to retract the jaws 6 and to protect them from docking shocks when they are in open position.

Of course, the invention is not limited to the example described above and various modifications can be applied to it without departing from the scope of the invention.

Thus, a single guide rail 3 can be fixed to the docking point, the jaws 6 clamping this rail 3 on two opposite faces of the latter.

Similarly, the hydraulic actuator 15 can be replaced with any other adequate means of displacement, such as an electromechanical screwing means or a pneumatic actuator.

Similarly, in another embodiment of the invention, the clamp forming means 4 can be driven directly by two actuators, without using the connecting rods 17.

We claim:

1. A device for mooring a craft to a docking point, which comprises a combination of at least one guide rail rigidly fixed vertically to the docking point permitting no relative movement between the rail and the docking point, and clamp forming means rigidly joined to the craft and including jaws suited, in a closed position, for clamping two opposite faces of the guide rail and for moving along the guide rail, driving means rigidly joined to the craft for controlling the movement of the jaws between said closed position and an open position in which the jaws are separated from the guide rail, and wherein the full set of mobile members, including the clamp forming means and the driving means are mounted inside a casing, said casing being fixed to the craft via damping devices.

2. A mooring device according to claim 1, wherein the device includes two parallel guide rails, the jaws of said clamp forming means being suited for clamping the two guide rails in the closed position.

3. A mooring device according to claim 1, wherein the jaws of said clamp forming means respectively comprise a roller for rolling on said rail.

4. A mooring device according to claim 3, wherein the rollers are mounted so as to respectively pivot on a support shaft via a plain bearing.

5. A mooring device according to claim 1, wherein the driving means comprise actuators for moving, to-and-fro, and a rod connected to each jaw of said clamp forming means respectively by a connecting rod.

6. A mooring device according to claim 1, wherein the driving means further include a manual control for placing the jaws of the clamp forming means in said open position.

7. A mooring device according to claim 1, further comprising a rupture device for withstanding a tractive force existing between the guide rail and the clamp forming means in closed position and for automatically controlling, above a maximum tractive force, the driving means to place the clamp forming means in open position.

8. A mooring device according to claim 1, wherein the guide rail has a circular cross-section.

9. A mooring device according to claim 8, wherein each jaw comprises a roller including a groove of cross-sectional profile consisting of two adjacent identical portions of an arc of a circle having a radius of curvature greater than the radius of curvature of the cross section of the guide rail, each portion of the arc being tangent to the guide rail at a distinct point when the jaws are in the closed position.

10. A mooring device according to claim 9, wherein the damping devices consist of pieces made of elastomer.

11. Device according to claim 1, wherein the device is coupled to a V-shaped centering device.

12. A mooring device according to claim 11, wherein the centering device is also mounted in the casing.

* * * * *